US006065634A

United States Patent [19]

Brifcani et al.

[11] Patent Number: 6,065,634

[45] Date of Patent: May 23, 2000

[54] CAN END AND METHOD FOR FIXING THE SAME TO A CAN BODY

[75] Inventors: Mouayed Mamdooh Brifcani, Oxfordshire; Peter James Hinton, Swindon Wiltshire; Mark Christopher Kysh, Wantage, all of United Kingdom

[73] Assignee: Crown Cork & Seal Technologies Corporation, Alsip, Ill.

[21] Appl. No.: 08/945,698

[22] PCT Filed: Mar. 25, 1996

[86] PCT No.: PCT/GB96/00709

§ 371 Date: Apr. 13, 1998

§ 102(e) Date: Apr. 13, 1998

[87] PCT Pub. No.: WO96/37414

PCT Pub. Date: Nov. 28, 1996

[30] Foreign Application Priority Data

May 24, 1995 [GB] United Kingdom ..... 9510515

[51] Int. Cl.[7] ..... B21D 51/44

[52] U.S. Cl. ..... 220/619; 220/620; 220/906; 220/623

[58] Field of Search ..... 220/619, 620, 220/623, 625, 621, 617, 615, 610, 62.22, 62.12, 268, 269, 270, 906

[56] References Cited

U.S. PATENT DOCUMENTS

| | | | |
|---|---|---|---|
| D. 279,265 | 6/1985 | Turner et al. . | |
| D. 285,661 | 9/1986 | Brownbill . | |
| D. 300,608 | 4/1989 | Taylor et al. . | |
| D. 304,302 | 10/1989 | Dalli et al. . | |
| D. 337,521 | 7/1993 | McNulty . | |
| D. 347,172 | 5/1994 | Heynan et al. . | |
| D. 352,898 | 11/1994 | Vacher . | |
| D. 406,236 | 3/1999 | Brifcani et al. . | |
| 3,023,927 | 3/1962 | Ehman | 220/619 |
| 3,967,752 | 7/1976 | Cudzik . | |
| 4,015,744 | 4/1977 | Brown . | |
| 4,024,981 | 5/1977 | Brown . | |
| 4,148,410 | 4/1979 | Brown . | |
| 4,150,765 | 4/1979 | Mazurek . | |
| 4,210,257 | 7/1980 | Radtke . | |
| 4,217,843 | 8/1980 | Kraska | 413/12 |
| 4,276,993 | 7/1981 | Hasegawa . | |
| 4,286,728 | 9/1981 | Fraze et al. . | |
| 4,448,322 | 5/1984 | Kraska | 220/623 |
| 4,606,472 | 8/1986 | Taube et al. | 220/500 |
| 4,674,649 | 6/1987 | Pavely . | |
| 4,681,238 | 7/1987 | Sanchez . | |
| 4,685,582 | 8/1987 | Pulciani et al. . | |
| 4,809,861 | 3/1989 | Wilkinson et al. | 220/623 |
| 4,893,725 | 1/1990 | Ball et al. . | |
| 5,064,087 | 11/1991 | Koch . | |
| 5,129,541 | 7/1992 | Voigt et al. . | |
| 5,494,184 | 2/1996 | Noguchi et al. . | |

FOREIGN PATENT DOCUMENTS

| | | |
|---|---|---|
| 0 153 115 A3 | 8/1985 | European Pat. Off. . |
| 2 196 891 | 5/1988 | United Kingdom . |
| 2 218 024 | 11/1989 | United Kingdom . |
| WO 93/17864 | 9/1993 | WIPO . |

*Primary Examiner*—Stephen Castellano
*Attorney, Agent, or Firm*—Burns Doane Swecker & Mathis L.L.P.

[57] ABSTRACT

A can end (22) comprising a peripheral cover hook (23), a chuck wall (24) dependent from the interior of the cover hook, an outwardly concave annular reinforcing bead (25) extending radially inwards from the chuck wall, and a central panel (26) supported by an inner portion (27) of the reinforcing bead, characterised in that, the chuck wall (24) is inclined to an axis perpendicular to the exterior of the central panel at an angle between 20° and 60°, and the concave cross-sectional radius of the reinforcing bead (25) is less than 0.75 mm.

9 Claims, 4 Drawing Sheets

CAN END AND METHOD FOR FIXING THE SAME TO A CAN BODY

This invention relates to an end wall for a container and more particularly but not exclusively to an end wall of a can body and a method for fixing the end wall to the can body by means of a double seam.

U.S. Pat. No. 4,093,102 (KRASKA) describes can ends comprising a peripheral cover hook, a chuck wall dependent from the interior of the cover hook, an outwardly concave annular re-inforcing bead extending radially inwards from the chuck wall and a central panel joined to an inner wall of the reinforcing bead by an annular outwardly convex bead. This can end is said to contain an internal pressure of 90 psi by virtue of the inclination or slope of the chuck wall, bead outer wall and bead inner wall to a line perpendicular to the centre panel. The chuck wall slope D° is between 14° and 16°, the outer wall slope B is less than 4° and the inner wall slope C° is between 10 and 16° leading into the outwardly convex bead. We have discovered that improvements in metal usage can be made by increasing the slope of the chuck wall and limiting the width of the anti peaking bead.

U.S. Pat. No. 4,217,813 (KRASKA) describes an alternative design of can end in which the countersink has inner and outer flat walls, and a bottom radius which is less than three times the metal thickness. The can end has a chuck wall extending at an angle of approximately 24° to the vertical. Conversely, our European Patent application EPO340955A describes a can end in which the chuck wall extends at an angle of between 12° and 20° to the vertical.

Our European Patent No. 0153115 describes a method of making a can end suitable for closing a can body containing a beverage such as beer or soft drinks. This can end comprises a peripheral flange or cover hook, a chuck wall dependant from the interior of the cover hook, an outwardly concave reinforcing bead extending radially inwards from the chuck wall from a thickened junction of the chuck wall with the bead, and a central panel supported by an inner portion of the reinforcing bead. Such can ends are usually formed from a prelacquered aluminum alloy such as an aluminum magnesium manganese alloy such as alloy 5182.

Our International Patent Application published no. WO93/17864 describes a can end suitable for a beverage can and formed from a laminate of aluminum/manganese alloy coated with a film of semi crystalline thermoplastic polyester. This polyester/aluminum alloy laminate permitted manufacture of a can end with a narrow, and therefore strong reinforcing bead in the cheaper aluminum manganese alloy.

These known can ends are held during double seaming by an annular flange of chuck, the flange being of a width and height to enter the anti-peaking bead. There is a risk of scuffing if this narrow annulus slips. Furthermore a narrow annular flange of the chuck is susceptible to damage.

Continuing development of a can end using less metal, whilst still permitting stacking of a filled can upon the end of another, this invention provides a can end compromising a peripheral cover hook, a chuck wall dependent from the interior of the chuck wall, an outwardly concave annular reinforcing bead extending radially inwards from the chuck wall, and a central panel supported by an inner portion of the reinforcing bead, characterised in that, the chuck wall is inclined to an axis perpendicular to the exterior of the central panel at an angle between 30° and 60°, and the concave bead narrower than 1.5 mm (0.060"). Preferably, the angle of the chuck wall to the perpendicular is between 40° and 45°.

In a preferred embodiment of the can end an outer wall of the reinforcing bead is inclined to a line perpendicular to the central panel at an angle between −15° to +15° and the height of the outer wall is up to 2.5 mm.

In one embodiment the reinforcing bead has an inner portion parallel to an outer portion jointed by said concave radius.

The ratio of the diameter of the central panel to the diameter of the peripheral curl is preferably 80% or less.

The can end may be made of a laminate of thermoplastic polymer film and a sheet aluminum alloy such as a laminate of a polyethylene teraphthalate film on an aluminium—manganese alloy sheet or ferrous metal typically less than 0.010 (0.25 mm) thick for beverage packaging. A lining compound may be placed in the peripheral cover hook.

In a second aspect this invention provides a method of forming a double seam between a can body and a can end according to any preceding claim, said method comprising the steps of:

placing the curl of the can end on a flange of a can body supported on a base plate, locating a chuck within the chuck wall of the can end to centre the can end on the can body flange, said chuck having a frustoconical drive surface of substantially equal slope to that of the chuck wall of the can end and a cylindrical surface portion extending away from the drive surface within the chuck wall, causing relative motion as between the assembly of can end and can body and a first operation seaming roll to form a first operation seam, and thereafter causing relative motion as between the first operation seam and a second operation roll to complete a double seam, during these seaming operations the chuck wall becoming bent to contact the cylindrical portion of the chuck.

Various embodiments will now be described by way of example and with reference to the accompanying drawings in which.

Figure 1:
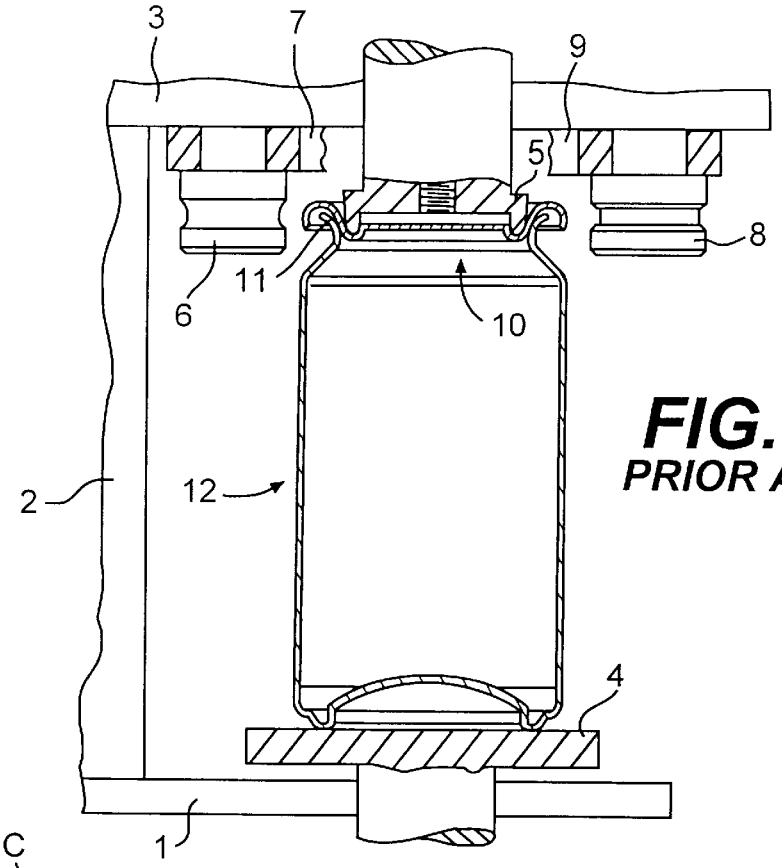
FIG. 1 PRIOR ART
FIG. 1 is a diagrammatic sketch of known apparatus for forming a double seam.

In FIG. 1, apparatus for forming a double seam comprises a base plate 1, an upright 2 and a top plate 3.

A lifter 4 mounted in the base plate is movable towards and away from a chuck 5 mounted in the top plate. The top plate supports a first operation seaming roll 6 on an arm 7 for pivotable movement towards and away from the chuck. The top plate also supports a second operation seaming roll 8 on an arm 9 for movement towards and away from the chuck after relative motion as between the first operation roll and can end on the chuck creates a first operation seam.

Figure 3:
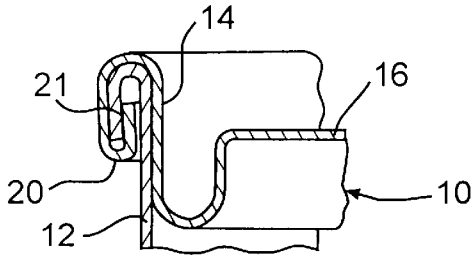
FIG. 3 PRIOR ART
FIG. 3 is a sectioned view of a fragment of a known double seam.

As shown in FIG. 1 the chuck 5 holds a can end 10 firmly on the flange 11 of a can body 12 against the support provided by the lifter plate 4. Each of the first operation roll 6 and second operation roll 7 are shown clear of chuck before the active seam forming profile of each roll is moved in turn to form the curl of the can end and body flange to a double seam as shown in FIG. 3.

Figure 2:
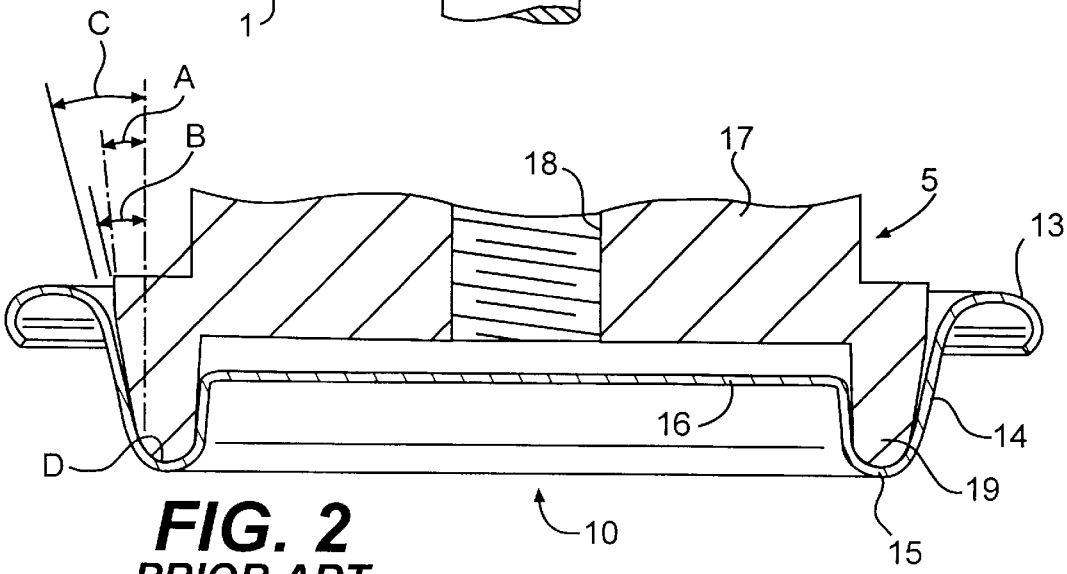
FIG. 2 PRIOR ART
FIG. 2 is an enlarged sectioned side view of a known chuck and can end before seaming.

FIG. 2 shows on an enlarged scale the chuck 5 and can end 10. The can end comprises a peripheral curl 13, a chuck wall 14 dependent from the interior of the curl, an outwardly concave anti-peaking bead 15 extending inwards from the chuck wall to support a central panel 16. Typically the chuck wall flares outwardly from the vertical at an angle C about 12° to 15°.

The chuck 5 comprises a body 17 having a threaded bore 18 permitting attachment to the rest of the apparatus (not shown). An annular bead 19 projects from the body 17 of the chuck to define with the end face of the body a cavity to receive the central panel 16 of the can end. The fit of panel 16 in annulus 19 may be slack between panel wall and chuck.

The exterior surface of the projecting bead 19 extends upwards towards the body at a divergent angle B of about 12° to the vertical to join the exterior of the chuck body 17 which tapers off an angle A° of about 4° to a vertical axis perpendicular to the central panel. The outer wall of the chuck 5 engages with the chuck wall at a low position marked "D" within the 12° shaped portion of the chuck bead 15.

As can ends are developed with narrower anti-peaking beads the chuck bead 19 becomes narrower and more likely to fracture. There is also a risk of scuffing of the can end at the drive position D which can leave unacceptable unsightly black marks after pasteurisation.

FIG. 3 shows a sectioned fragment of a typical double seam showing a desirable overlap of body hook 21 and end hook 20 between the can end 10 and can body 12.

Figure 4:
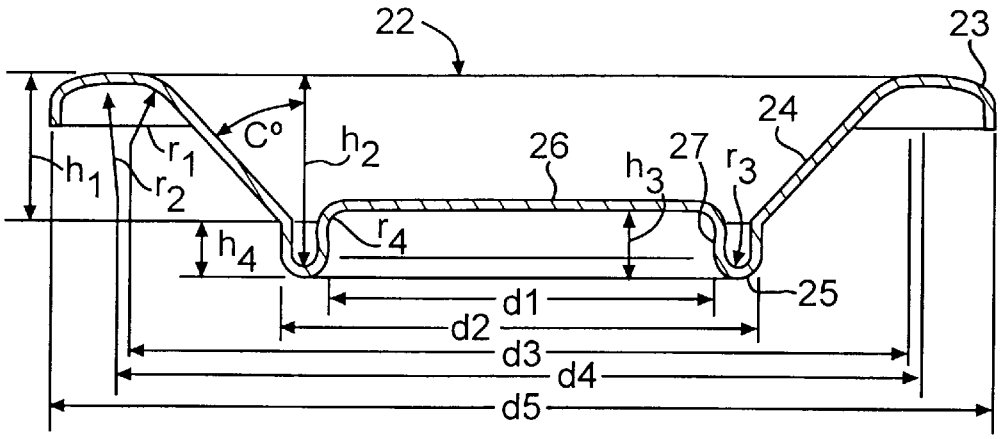
FIG. 4 is a sectioned side view of a can end according to this invention before edge curling.

FIG. 4 shows a can end, according to the invention, comprising a peripheral cover hook 23, a chuck wall 24 extending axially and inwardly from the interior of the peripheral cover hook, and outwardly concave reinforcing or anti-peaking bead 25 extending radially inwards from the chuck wall, and a central panel 26 supported or an inner portion panel with 27. The panel wall is substantially upright allowing for any metal spring back after pressing. The chuck wall is inclined to an axis perpendicular to the exterior of the central panel at an angle $C_1$ between 20° and 60°; preferably between 40° and 45°. Typically the cross sectional radius of the antipeaking bead is about 0.5 mm.

Preferably the anti-peaking bead 25 is parallel sided, however the outer wall may be inclined to a line perpendicular to the central panel at an angle between −15° and +15° and the height $h_1$ of the outer wall may be up to 2.5 mm.

This can end is preferably made from a laminate of sheet metal and polymeric coating. Preferably the laminate comprises an aluminum magnesium alloy sheet such as 5182, or aluminum manganese alloy such as 3004 with a layer of polyester film on one side. A polypropylene film may be used on the "other side" if desired.

Typical dimensions of the example of the invention are:

| | | |
|---|---|---|
| d5 | overall diameter (as stamped) | 65.83 mm |
| d4 | PC diameter of seaming panel radius | 61.54 mm |
| d3 | PC diameter of seaming panel/chuck wall radius | 59.91 mm |
| $r_1$ | seaming panel/chuck wall radius | 1.27 mm |
| $r_2$ | seaming panel radius | 5.56 mm |
| $r_3$ | concave radius in antipeaking bead | <1.5 mm |
| $d_2$ | maximum diameter of antipeaking bead | 50.00 mm |
| $d_1$ | minimum diameter of antipeaking bead | 47.24 mm |
| $h_2$ | overall height of can end | 6.86 mm |
| $h_1$ | height to top of antipeaking bead | 5.02 mm |
| $h_3$ | panel depth | 2.29 mm |
| $h_1$ | outer wall height | 1.78 mm |
| c | chuck wall angle to vertical | 43° |

From these dimensions it can be calculated that the ratio of central panel diameter of 47.24 mm to overall diameter of can end 65.84 is about 0.72 to 1.

For economy the aluminum alloy is in the form of sheet metal less than 0.010" (0.25 mm). A polyester film on the metal sheet is typically 0.0005" (0.0125 mm).

Although this example shows an overall height $h_2$ at 6.86 mm we have also found that useful can ends may be made with an overall height as little as 6.35 mm (0.25").

Figure 5:
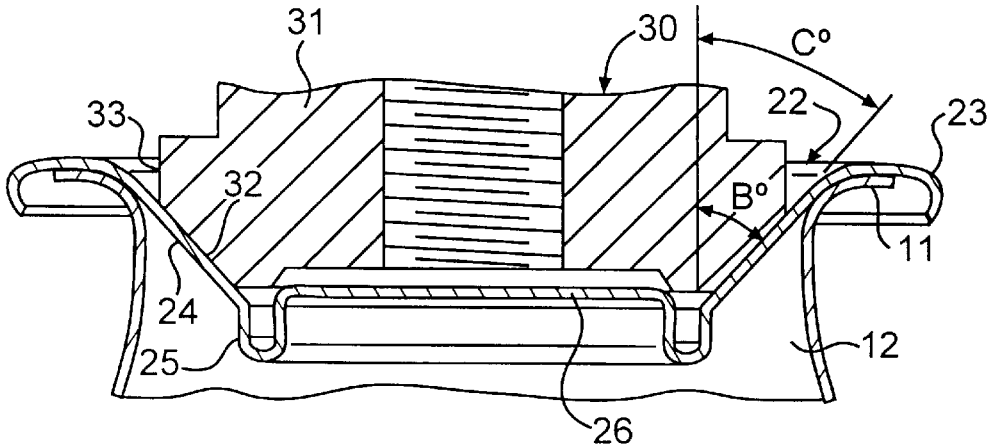
FIG. 5 is a sectioned side view of the can end of FIG. 4 on a can body before forming of a double seam.

FIG. 5 shows the peripheral flange 23 of can end 22 of FIG. 4 resting on the flange 11 of a can body 12 before formation of a double seam as discussed with reference to FIG. 1.

In FIG. 5 a modified chuck 30 comprises a chuck body 31 having a frustoconical drive surface 32 engaging with the chuck wall 24 of the can end 22.

The frustoconical drive surface is inclined outwardly and axially at an angle substantially equal to the angle of inclination C° of between 20° and 60°; in this particular example on chuck angle C of 43° is preferred. The drive surface 32 is a little shorter than the chuck wall 24 of the chuck body. The substantially cylindrical surface portion 33, rising above the drive surface 32, may be inclined at an angle between +4° and −4° to a longitudinal axis of the chuck. As in FIG. 2, this modified chuck 30 has a threaded aperture to permit attachment to the rest of the double seam forming apparatus (not shown).

In contrast to the chuck of FIG. 2 the modified chuck 30 is designed to drive initially on the relatively large chuck wall 32 without entering deeply into the anti-peaking bead 25. Further drive is obtained at the juncture of chuck wall 32 and cylindrical wall 33 as chuck wall of end 24 is deformed during 1st and 2nd operation seaming FIGS. 6 and 7. The chuck 30 shown in FIG. 5 has an annular bead of arcuate cross section but this bead is designed to enter the chuck wall without scratching or scuffing a coating on the can end; not to drive on the concave bead surface as shown in FIG. 2.

It will be understood that first operation seaming is formed using apparatus as described with reference to FIG. 1.

Figure 6:
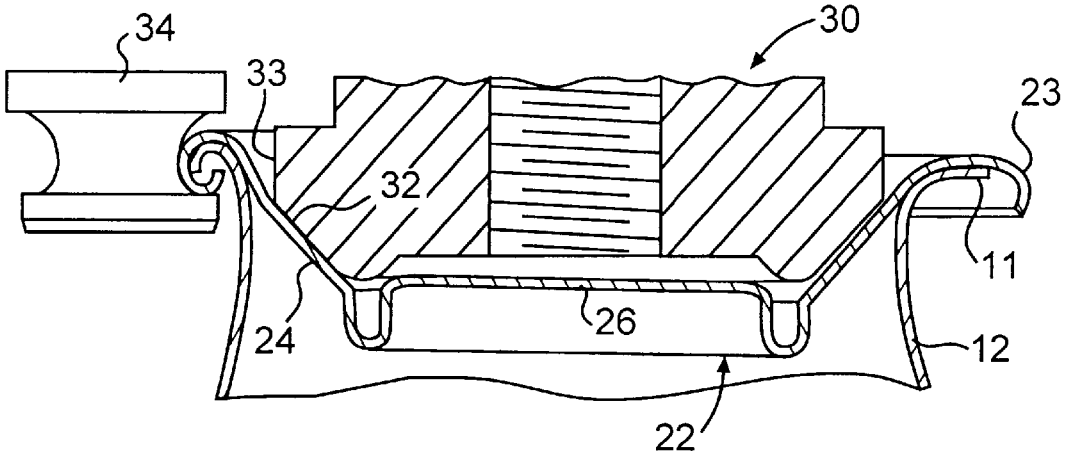
FIG. 6 is a like view of the can end and body during first operation seaming.

FIG. 6 shows the modified can end and chuck during formation of a first operation seam shown at the left of FIG. 2 as formed by a first operation roll 34 adjacent the interfolded peripheral flange of the can end and flange 11 body 12.

During relative rotation as between the can end 22 and first operation roll 34 the edge between the chuck drive wall 32 and cylindrical wall 33 exerts a pinching force between chuck 30 and roll 34 to deform the chuck wall of the can end as shown.

Figure 7:
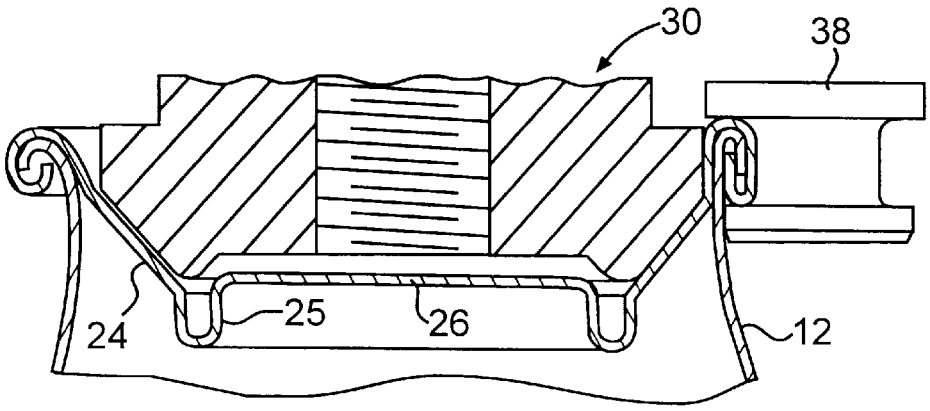
FIG. 7 is a like view of the can end and body during final second operation seaming to create a double seam.

After completion of the first operation seam the first operation roll is swung away from the first operation seam and a second operation roll 38 is swung inwards to bear upon the first operation seam supported by the chuck 30. Relative rotation as between the second operation roll 38 and first operation seam supported by a chuck wall 30 completes a double seam as shown in FIG. 7 and bring the upper portion 24 of the chuck wall 24 to lie tightly against the can body neck in a substantially upright attitude as the double seam is tightened by pinch pressure between the second operation roll 38 and chuck 30.

Can ends according to the invention were made from aluminum alloy 5182 and an aluminum alloy 3004/polymer laminate sold by CarnaudMetalbox under the trade mark ALULITE. Each can end was fixed by a double seam to a drawn and wall ironed (DWI) can body using various chuck angles and chuck wall angle as tabulated in Table 1 which records the pressure inside a can at which the can ends failed:

TABLE 1

| SAMPLE CODE | CAN END DATA: MATERIAL Thickness mm | MINIMUM Diameter D1 mm | CHUCK WALL ANGLE "C" | PRESSURE IN BAR (PSIG) TO FAILURE FOR VARIOUS SEAMING CHUCK ANGLES B°: 23° | 10°/23° | 4°/23° | 23° WITH D. SEAM RING | 10/20 /23° WITH D. SEAM RING |
|---|---|---|---|---|---|---|---|---|
| A | ALULITE 0.23 | 52.12 (2.052") | 21.13° | 5.534 (80.20) | 5.734 (83.10) | 5.311 (76.97) | 6.015 (87.17) | 5.875 (85.14) |
| B | 5182 0.244 | 52.12 (2.052") | 21.13° | 5.599 (81.15) | 5.575 (80.79) | 5.381 (77.99) | 5.935 (86.01) | 5.895 (85.43) |
| C | 5182 0.245 | 52.12 (2.052") | 21.13° | 6.004 (87.02) | 5.910 (85.65) | 5.800 (84.06) | 6.224 (90.21) | 6.385 (92.54) |
| D | ALULITE 0.23 | 51.92 (2.044") | 21.13° | 5.334 (77.31) | 5.229 (75.78) | 5.238 (75.91) | 5.730 (83.04) | 5.404 (78.32) |
| E | 5182 0.224 | 51.92 (2.044") | 21.13° | 5.555 (80.50) | 5.514 (79.92) | 5.354 (77.60) | 5.895 (85.43) | 5.930 (55.94) |
| F | 5182 0.245 | 51.92 (2.044") | 23° | 5.839 (84.63) | 5.804 (84.12) | 5.699 (82.59) | 6.250 (90.58) | 6.435 (93.26) |
| G | ALULITE 0.23 | 51.92 (2.044") | 23° | | | 5.123 (74.25) | | |
| H | 5182 0.224 | (51.92) (2.044") | 23° | | | 5.474 (79.34) | | |
| I | 5182 0.245 | 51.92 (2.044") | 23° | | | 5.698 (82.58) | | |

All pressures on unaged shells in bar (psig). 5182 is an aluminium-magnesium-manganese alloy lacquered. The "ALULITE" used is a laminate of aluminium alloy and polyester film.

The early results given in Table 1 showed that the can end shape was already useful for closing cans containing relatively low pressures. It was also observed that clamping of the double seam with the "D" seam ring resulted in improved pressure retention. Further tests were done using a chuck wall angle and chuck drive surface inclined at nearly 45°: Table 2 shows the improvement observed:

TABLE 2

| Sample Code | $h_2$ mm (inches) | $h_3$ mm(inches) | $h_4$ mm (inches) | Chuck Angles B°: 43° | 43° with seam ring |
|---|---|---|---|---|---|
| J | 6.86 (0.270) | 2.39(0.094) | 2.29 (0.09) | 4.89(70.9) | 6.15(89.1) |
| K | 7.11 (0.280) | 2.64(0.104) | 2.54 (0.10) | 4.83(70.0) | 5.98(86.6) |
| L | 7.37 (0.290) | 2.80(0.114) | 2.79 (0.11) | 4.74(68.7) | 6.44(93.3) |

Table 2 is based on observations made on can ends made of aluminum coated with polymer film (ALULITE) to have a chuck wall length of 5.029 mm (0.198") up the 43° slope.

It will be observed that the container pressures achieved for samples J, K, L, 4.89 bar (70.9 psig), 4.83 bar (70.0 psig) and 4.74 bar (68.7 psig) respectively were much enhanced by clamping the double seam.

In order to provide seam strength without use of a clamping ring, modified chucks were used in which the drive slope angle C° was about 43° and the cylindrical surface 33 was generally +4° and −4°. Results are shown in Table 3.

TABLE 3

| SAMPLE CODE | MATERIAL | LINING COMPOUND | CHUCK ANGLES DRIVE/WALL | PRESSURE |
|---|---|---|---|---|
| c | 0.224 5182 | with | 43° | 4.60 (66.7) |
| g | 0.23 Alulite | with | 43°/4° | 5.45 (79.0) |

TABLE 3-continued

| SAMPLE CODE | MATERIAL | LINING COMPOUND | CHUCK ANGLES DRIVE/WALL | PRESSURE |
|---|---|---|---|---|
| h | 0.224 5182 | with | 43°/4° | 6.46 (93.6) |
| j | 0.23 Alulite | without | 43°/4° | 5.91 (85.6) |
| k | 0.244 5182 | without | 43°/4° | 6.18 (89.6) |
| l | 0.23 Alulite | without | 43°/−4° | 5.38 (77.9) |
| m | 0.25 Alulite | without | 43°/−4° | 6.20 (89.8) |
| n | 0.23 Alulite | without | 43°/0° | 6.11 (88.5) |
| o | 0.25 Alulite | without | 43°/0° | 6.62 (95.9) |

ALL PRESSURES IN BAR (PSIG)
ALL CODES
Reform Pad Dia. 47.24 mm (1.860") (202 Dia).
6.86 mm (0.270") unit Depth $h_2$ 2.39 mm (0.094") Panel Depth Table 3 shows Code "O" made from 0.25 mm Alulite to give 6.62 bar (95 psi) Pressure Test Result indicating a can end suitable for pressurised beverages. Further chucks with various hand lengths (slope) were tried as shown in Table 4.

TABLE 4

| VARIABLE CODE | CHUCK WALL ANGLE: 43°/0° 1.9 mm LAND SHARP TRANSITION: NO. D.SEAM RING | WITH D.SEAM RING | 43°/0° 1.27 MM LAND R. 0.5 MM BLEND: NO. D.SEAM RING | WITH D.SEAM RING |
|---|---|---|---|---|
| 7 | 6.699(97.08) | 7.017(101.7) | 6.779(98.24) | 7.006(101.54) |
| 8 | 6.315(91.52) | 6.521(94.5) | 6.293(91.2) | 6.236(90.37) |
| 9 | 6.095(88.33) | 6.30(91.3) | 6.238(90.4) | 6.719(97.38) |

ALL PRESSURES IN BAR (PSIG)

CODE

7=0.25 mm Alulite, 47.24 mm (1.860") Reform Pad, 6.86 mm (0.270") $h_2$ Depth, 2.38 mm (0.094") Panel; $h_4$ depth=2.29 mm (0.09")

8=0.23 mm Alulite, 47.24 mm (1.860") Reform Pad, 7.11 mm (0.280") $h_2$ Depth, 2.64 mm (0.104") Panel; $h_4$ depth=2.54 mm (0.10")

9=0.23 mm Alulite, 47.24 mm (1.860") Reform Pad, 7.37 mm (0.290") $h_2$ Depth, 2.90 mm (0.114") Panel; $h_4$ depth=2.79 mm (0.11")

Table 4 shows results of further development to seaming chuck configuration to bring closer the pressure resistance of ring supported and unsupported double seams.

Table 4 identifies parameters for length of generally vertical cylindrical surface 33 on the seaming chuck 30, and also identifies a positional relationship between the chuck wall 24 of the end and the finished double seam. It will be understood from FIG. 7 shows that the forces generated by thermal processing or carbonated products are directed towards the resisted by the strongest portions of the completed double seam.

Figure 8:
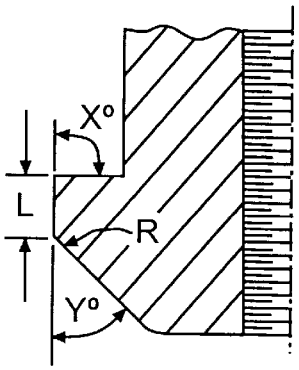
FIG. 8 is a fragmentary section of a chuck detail.

Table 5 shows results obtained from a typical seam chuck designed to give double seam in accordance with parameters and relationships identified in Table 4. Typically:—As shown in FIG. 8 the chuck comprises a cylindrical land of length '1' typically 1.9 mm (0.075") and frustoconical drive surface 32 inclined at an angle Y°, typically 43°, to the cylindrical to which it is joined by a radius R typically 0.5 mm (0.020"). Angle "X" is typically 90°.

TABLE 5

| | | DIMENSIONS mm | | PRESSURE | |
|---|---|---|---|---|---|
| CODE | GAUGE | $h_2$ | $h_3$ | bar | (psi) |
| 20 | .23 mm | 7.37 (.290") | 2.36 (.093") | 6.383 | (92.6) |
| 21 | .23 mm | 7.37 (.290") | 2.36 (.093") with compound | 6.402 | (92.8) |

TABLE 5-continued

| | | DIMENSIONS mm | | PRESSURE | |
|---|---|---|---|---|---|
| CODE | GAUGE | $h_2$ | $h_3$ | bar | (psi) |
| 26 | .23 mm | 6.87 (.2705") | 2.37 (.0935") | 6.144 | (89.88) |
| 27 | .23 mm | 6.87 (.2705") | 2.37 (.0934") with compound | 6.071 | (88.0) |
| 28 | .23 mm | 7.37 (.290") | 2.36 (.093") | 6.414 | (93.0) |
| 29 | .23 mm | 7.37 (.290") | 2.84 (.112") | 6.725 | (97.5) |
| 30 | .23 mm | 6.86 (.270") | 2.37 (.0935") | 6.062 | (87.9) |
| 31 | .23 mm | 6.86 (.270") | 2.37 (.0935") | 6.013 | (87.2) |
| 34 | .25 mm | 7.37 (.290") | 2.87 (.113") | 7.787 | (112.9) |
| 36 | .25 mm | 7.32 (.288") | 2.34 (.092") | 7.293 | (105.8) |
| 37 | .25 mm | 7.32 (.288") | 2.34 (.092") with compound | 7.402 | (107.3) |
| 38 | .25 mm | 6.87 (.2705") | 2.41 (.095") | 7.077 | (102.6) |
| 516 | .25 mm | 6.35 (.250") | 2.34 (.092") with compound | 6.937 | (100.6) |

All variables made from Alulite, 10 Can per variable.

The can ends may be economically made of thinner metal if pressure retention requirements permit because these can ends have a relatively small centre panel in a stiffer annulus.

Figure 9:
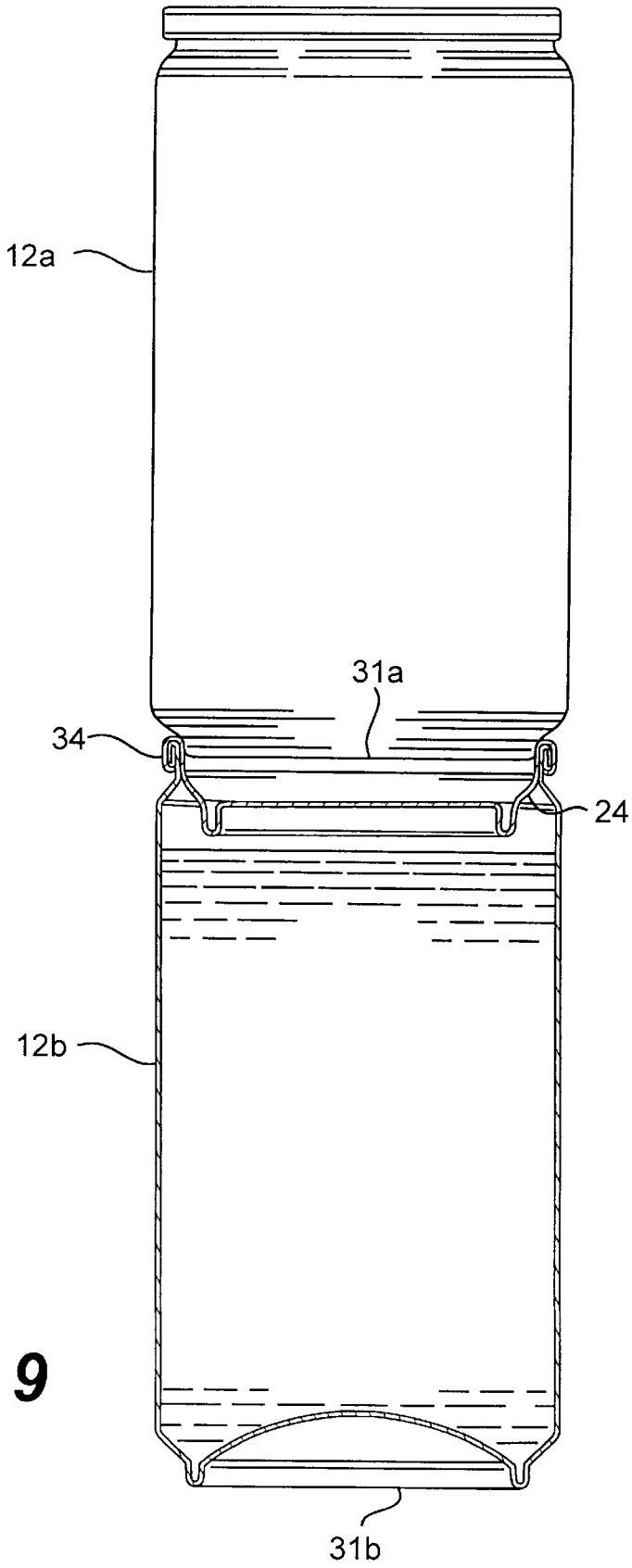
FIG. 9 is a side view of the cans stacked one on the other.

FIG. 9 shows a can 12*a*, closed according to this invention, stacked upon a like can 12*b* shown sectioned so that stacking of the upper can on the lower can end is achieved by a stand bead 31*a* of the upper can fits inside the chuck wall 24 of the lower can end with the weight of the upper can resting on the double seam 34 of the lower can end.

The clearance between the bottom of the upper can body and lower can end may be used to accommodate ring pull features (not shown) in the can end or promotional matter such as an coiled straw or indicia.

Using the experimental data presented above, a computer programme was set up to estimate the resistance to deformation available to our can ends when joined to containers containing pressurised beverage. The last two entries on the table relate to a known 206 diameter beverage can end and an estimate of what we think the KRASKA patent teaches.

TABLE 6

| END SIZE Bead O:D:1D $d_2$:$d_1$ | OVERALL DIA $d_2$ mm | PANEL DIA $d_1$ mm | RATIO $D_2/D_1$ | CHUCK WALL ANGLE B° | CHUCK WALL LENGTH L mm | RE-ENFORCING RAD $r_3$ mm | INNER WALL HEIGHT $h_3$ mm | OUTER WALL HEIGHT $h_4$ mm | PRE-DICTED CUT EDGE φ (* DENOTES ACTUAL) | ACTUAL THICKNESS TO CONTAIN PSI |
|---|---|---|---|---|---|---|---|---|---|---|
| 206–204 | 64.39 (2.535") | 49.49 (1.9485") | 1.3010 | 33.07° | 4.22 (0.166") | 0.52 (0.0204") | 2.34 (0.092") | 1.78 (0.070") | 75.230 (2.9618") | 0.255 |
| 206–202 | 64.39 (2.535") | 47.33 | 1.3604 | 42.69° | 4.95 (0.185") | 0.52 (0.0204") | 2.34 (0.092") | 1.78 (0.070") | 74.272 | 0.255 |
| 206–200 | 64.39 (2.535") | 45.07 (1.7744") | 1.4287 | 50.053° | 5.82 (0.229") | 0.52 (0.0204") | 2.34 (0.092") | 1.78 (0.070") | 73.713 (2.9021") | 0.255 |
| 204–202 | 62.18 (2.448") | 47.33 (1.8634") | 1.3137 | 29.78° | 3.96 (0.156") | 0.52 (0.0204") | 2.34 (0.092") | 1.78 (0.070") | 73.767 (2.9042") | 0.24 |
| 204–200 | 62.18 (2.448") | 45.07 (1.7744") | 1.3796 | 40.786° | 4.70 (0.185") | 0.52 (0.0204") | 2.34 (0.092") | 1.78 (0.070") | 72.911 (2.8705") | 0.24 |
| 202–200 | 71.98 (2.834") | 45.07 (1.7744") | 1.597 | 30.266" | 4.09 (0.161") | 0.52 (0.0204") | 2.34 (0.092") | 1.78 (0.070") | 71.984 (2.834") | 0.225 |
| 206 std | 64.69 (2.547") | 51.92 (2.044") | 1.2461 | 15.488° | 4.39 (0.173") | 0.56 (0.022") | 2.03 (0.080") | — | 76.454 (3.010")* | 0.28 |
| KRASKA ESTIMATE | 64.39 (eg 2.535") | — | — | 15° | 2.54 (0.100") | 0.81 (0.032") | 1.65 (0.065") | 2.29 (0.090") | 78.080 (3.074") | 0.292 (0.0115") |

All experiments modelled on a notional aluminium alloy of yield strength 310 mpa 0.25 mm thick. The standard was also 310 mpa BUT 0.275 mm thick.

What is claimed is:

1. A can end comprising;

a peripheral cover hook;

a chuck wall dependent from an interior of the cover hook;

an outwardly concave annular reinforcing bead extending radially inwards from the chuck wall; and a central panel supported by an inner portion of the reinforcing bead;

wherein the chuck wall is inclined to an axis perpendicular to the exterior of the central panel at an angle between 40° and 60°, and a concave cross-sectional radius of the reinforcing bead is less than 0.75 mm.

2. The can end according to claim 1, wherein the angle of the chuck wall to the perpendicular axis is between 40° and 45°.

3. The can end according to claim 1, wherein an outer wall of the reinforcing bead is inclined to a line perpendicular to the central panel of the can end at an angle between −15° and +15° and the height of the outer wall is up to 2.5 mm.

4. The can end according to claim 1, wherein the reinforcing bead has an inner portion parallel to an outer portion joined by said concave radius.

5. The can end according to claim 1, wherein the ratio of the diameter of the central panel to the diameter of the peripheral cover hook is 80% or less.

6. The can end according to claim 1, wherein the can end is made of a laminate of thermoplastic polymer film and a sheet aluminum alloy.

7. The can end according to claim 1, wherein the can end is made of tinplate.

8. The can end according to claim 1, wherein the can end is made of electrochrome coated steel.

9. A can end comprising:

a peripheral cover hook;

a chuck wall dependent from an interior of the cover hook;

an outwardly concave annular reinforcing bead extending radially inwards from the chuck wall; and a central panel supported by an inner portion of the reinforcing bead;

wherein the chuck wall in inclined to an axis perpendicular to the exterior of the central panel at an angle between 30° and 60°, and a concave cross-sectional radius of the reinforcing bead is less than 0.75 mm;

wherein the can end is made of a laminate of thermoplastic polymer film and a sheet aluminum alloy; and wherein the laminate comprises a polyethylene teraphthalate film on an aluminum-manganese-alloy sheet less than 0.25 mm thick.

* * * * *